US005821871A

United States Patent [19]

Benzler

[11] Patent Number: 5,821,871

[45] Date of Patent: Oct. 13, 1998

[54] AUTHENTICATION METHOD

[75] Inventor: Hartwig Benzler, Feldkirchen, Germany

[73] Assignee: SC-Info+Inno Technologie Informationen+Innovationen GMBH CC, Germany

[21] Appl. No.: 682,524

[22] PCT Filed: Jan. 19, 1995

[86] PCT No.: PCT/EP95/00178

§ 371 Date: Jun. 25, 1996

§ 102(e) Date: Jun. 25, 1996

[87] PCT Pub. No.: WO95/20802

PCT Pub. Date: Aug. 3, 1995

[30] Foreign Application Priority Data

| | | | |
|---|---|---|---|
| Jan. 27, 1994 | [DE] | Germany | 44 02 430.4 |
| May 11, 1994 | [DE] | Germany | 44 16 665.6 |
| Jun. 7, 1994 | [DE] | Germany | 44 19 882.5 |
| Jul. 5, 1994 | [DE] | Germany | 44 23 415.5 |
| Aug. 26, 1994 | [DE] | Germany | 44 30 368.8 |
| Dec. 4, 1994 | [DE] | Germany | 44 43 039.6 |
| Oct. 11, 1995 | [DE] | Germany | 44 36 340.0 |

[51] Int. Cl.[6] ..... G07D 7/00

[52] U.S. Cl. ..... 340/825.34; 340/825.31; 235/382

[58] Field of Search ..... 340/825.31, 825.34; 235/382, 382.5; 380/45

[56] References Cited

U.S. PATENT DOCUMENTS

| | | | |
|---|---|---|---|
| 4,432,567 | 2/1984 | Stockburger et al. | 283/83 |
| 4,449,189 | 5/1984 | Feix et al. | 364/513.5 |
| 5,037,301 | 8/1991 | Michnick et al. | 433/229 |
| 5,109,427 | 4/1992 | Yang | 382/4 |

(List continued on next page.)

FOREIGN PATENT DOCUMENTS

| | | |
|---|---|---|
| A-0 006 419 | 1/1980 | European Pat. Off. . |
| B-0 007 002 | 1/1980 | European Pat. Off. . |
| B-0 029 894 | 6/1981 | European Pat. Off. . |
| A-0 034 755 | 9/1981 | European Pat. Off. . |

(List continued on next page.)

OTHER PUBLICATIONS

Smith, "Authenticating users by word association," Computers & Security, vol. 6, No. 6, 1987, Amsterdam, NL, pp. 464–470, XP 000050578.

Zviran, "Cognitive passwords: the key to easy access control," Computers & Security, vol. 9, No. 8, 1990, Amsterdam, NL, pp. 723–736, XP 000176620.

*Primary Examiner*—Brian Zimmerman
*Assistant Examiner*—Edward Merz
*Attorney, Agent, or Firm*—Fitch, Even, Tabin & Flannery

[57] ABSTRACT

An authentifying method is revealed which uses as an identification feature images, tokens, texts or sounds which are based on individual knowledges and experiences of a person (PSPI) and which consist of a principal part and a complement or of associated notions, with that person performing the following steps with regard to a plurality of these PSPI: first register them within a memory and keep them inaccessible to other people, secondly make them visible or audible without the complement and in a sequence which other persons cannot foresee, thirdly restore them with the missing complement or verify them; or first subdivide them into their associated elements and assemble and register the latter ones within a plurality of element groups according to superordinated categories of these associated elements, whereby the elements may be accompanied by tokens like numbers or letters, secondly make them visible, audible or available in their subdivided form according to the groups, for the elements of one category in a determined sequence and for the elements of the other categories in a random sequence, thirdly and still in subdivided form, put them together into characteristic two-dimensional structures or linear chains, by means of connecting associated elements of the respective element groups and of connecting these reconstituted PSPI in a sequence which is defined by the way in which the elements were registered, made visible, audible or available, or by the inherent nature of the elements.

25 Claims, 11 Drawing Sheets

U.S. PATENT DOCUMENTS

| | | | |
|---|---|---|---|
| 5,150,409 | 9/1992 | Elsner | 380/23 |
| 5,317,637 | 5/1994 | Pichlmaier et al. | 380/25 |
| 5,323,146 | 6/1994 | Glaschick | 340/825.31 |
| 5,395,319 | 3/1995 | Hirsch et al. | 604/60 |

FOREIGN PATENT DOCUMENTS

| | | |
|---|---|---|
| A-0 082 304 | 6/1983 | European Pat. Off. . |
| B-0 085 680 | 6/1986 | European Pat. Off. . |
| A-0 382 410 | 8/1990 | European Pat. Off. . |
| B-0 441 774 | 8/1991 | European Pat. Off. . |
| A-0 466 146 | 1/1992 | European Pat. Off. . |
| A-0 522 473 | 1/1993 | European Pat. Off. . |
| A-0 532 227 | 3/1993 | European Pat. Off. . |
| A-0 548 967 | 6/1993 | European Pat. Off. . |
| A-0 564 832 | 10/1993 | European Pat. Off. . |
| A-0 573-245 | 12/1993 | European Pat. Off. . |
| B-683 233 | 10/1939 | Germany . |
| AS-1 084 036 | 6/1960 | Germany . |
| AS 1 195 057 | 6/1965 | Germany . |
| AS 1 762 669 | 9/1970 | Germany . |
| A-2-224 667 | 12/1972 | Germany . |
| A-2 254 597 | 5/1973 | Germany . |
| A-2 846 974 | 7/1980 | Germany . |
| A-3 301 629 | 7/1984 | Germany . |
| B-3 827 172 | 3/1989 | Germany . |
| A-3 834 046 | 4/1990 | Germany . |
| A-3 834 048 | 4/1990 | Germany . |
| A-4 036 025 | 5/1991 | Germany . |
| A-3 943 097 | 7/1991 | Germany . |
| A-4 005 448 | 8/1991 | Germany . |
| B-4 008 971 | 9/1991 | Germany . |
| B-4 009 051 | 9/1991 | Germany . |
| A-4 039 648 | 7/1992 | Germany . |
| A-4 107 042 | 9/1992 | Germany . |
| A-4 220 971 | 1/1993 | Germany . |
| A-4 125 870 | 2/1993 | Germany . |
| 2 058 417 | 4/1981 | United Kingdom . |
| 2 112 190 | 7/1983 | United Kingdom . |
| WO 93/09621 | 5/1993 | WIPO . |
| WO A 93/24906 | 12/1993 | WIPO . |

Figure 5

| | | | C 0 | C 1 | C 2 | C 3 | C 4 |
|---|---|---|---|---|---|---|---|
| Surname 0 | First name 0 | -- | z00 | z10 | z20 | z30 | z40 |
| Surname 1 | First name 1 | -- | z01 | z11 | z21 | z31 | z41 |
| Surname 2 | First name 2 | -- | z02 | z12 | z22 | z32 | z42 |
| Surname 3 | First name 3 | -- | z03 | z13 | z23 | z33 | z43 |
| Surname 4 | First name 4 | -- | z04 | z14 | z24 | z34 | z44 |
| Surname 5 | First name 5 | -- | z05 | z15 | z25 | z35 | z45 |
| Surname 6 | First name 6 | -- | z06 | z16 | z26 | z36 | z46 |
| Surname 7 | First name 7 | -- | z07 | z17 | z27 | z37 | z47 |
| Surname 8 | First name 8 | -- | z08 | z18 | z28 | z38 | z48 |
| Surname 9 | First name 9 | -- | z09 | z19 | z29 | z39 | z49 |

Figure 7

PinCard - Personal secret codes

Surname: MUSTERMANN
First name: Moritz

Street: Lindenweg 99
City: D-99999 Moritzkirchen

Tel.: 0999-12 34 56 78
Divers: Please return to address

| SURNAMES | PIN 1 4 Ziff. | | PIN 2 4 Ziff. | | PIN 3 5 Ziff. | | PIN 4 6 Ziff. | | PIN 5 10 Ziff. | | PIN 6 6 Bu. | | PIN 7 8 Bu. | | PIN 8 10 Bu. | | First names |
|---|---|---|---|---|---|---|---|---|---|---|---|---|---|---|---|---|---|
| *HEUSS* | A | 4 | | 2 | | 9 | A | 1 | A | 7 | | G | 1 | H | 1 | W | *Ludwig* |
| *ADENAUER* | | 0 | A | 6 | | 4 | B | 3 | B | 8 | | Z | 2 | Z | 2 | I | *Erich* |
| *SCHUMACHER* | B | 6 | | 3 | A | 2 | | 0 | C | 0 | 1 | E | 3 | A | 3 | O | *Kurt* |
| *WEHNER* | | 8 | B | 8 | | 0 | C | 5 | D | 1 | | U | 4 | L | 4 | B | *Jakob* |
| *BRANDT* | C | 3 | | 4 | B | 6 | | 6 | E | 5 | | R | 5 | G | 5 | A | *Theodor* |
| *ERHARD* | | 5 | C | 7 | | 5 | D | 7 | F | 8 | 2 | C | 6 | N | 6 | Q | *Ernst* |
| *HEINEMANN* | D | 7 | | 9 | C | 8 | | 1 | G | 6 | 3 | F | 7 | R | 7 | S | *Herbert* |
| *OLLENHAUER* | | 2 | D | 0 | | 7 | E | 8 | H | 2 | 4 | K | 8 | E | 8 | U | *Willy* |
| *KAISER* | | 1 | | 2 | D | 1 | | 9 | I | 7 | 5 | S | | Q | 9 | H | *Konrad* |
| *REUTER* | | 9 | | 3 | E | 3 | F | 4 | K | 9 | 6 | M | | D | 0 | D | *Gustav* |

Figure 9

Identity Card

Card-No.: 2 042 071 872

Card owner:
Moritz MUSTERMANN

Birthday: 31-12-1967

Residence:
Lindenweg 99
D-99999 Moritzkirchen

Valid until: 31-12-1999

| | | |
|---|---|---|
| A1 | 2 | B15 |
| A8 | 3 | B7 |
| A15 | 5 | B14 |
| A3 | 7 | B2 |
| A13 | 11 | B12 |
| A6 | 13 | B5 |
| A11 | 17 | B10 |
| A4 | 19 | B3 |
| A9 | 23 | B8 |
| A14 | 29 | B13 |
| A2 | 31 | B1 |
| A12 | 37 | B11 |
| A7 | 41 | B6 |
| A10 | 43 | B9 |
| A5 | 47 | B4 |

Nx = BZ of Ax times BZ of A(x+1) times BZ of A(x+2)

EZ = Sum of all Nx power 2

Figure 10

Stored Data:

1. Series of 16 surnames each with one basic number;
2. Series of 16 first names;
3. One result number.
4. One algorithm.

EZ = 6 927 236 929

| | | |
|---|---|---|
| ADENAUER | 19 | August |
| ERHARD | 11 | Bertold |
| SCHARPING | 37 | Ernst |
| WEHNER | 23 | Gerhard |
| HEUSS | 3 | Gustav |
| BRANDT | 47 | Helmut |
| SCHUMACHER | 17 | Herbert |
| KOHL | 53 | Jakob |
| BRECHT | 5 | Konrad |
| WÖRNER | 43 | Kurt |
| HEINEMANN | 29 | Ludwig |
| BEBEL | 7 | Manfred |
| REUTER | 41 | Oskar |
| SCHRÖDER | 13 | Rudolf |
| KAISER | 31 | Theodor |
| LAFONTAINE | 2 | Willy |

$$Zx = BZx \cdot BZx+1 \cdot BZx+2$$
$$EZ = \text{Sum of all } Zx \cdot Zx$$

Figure 11 A
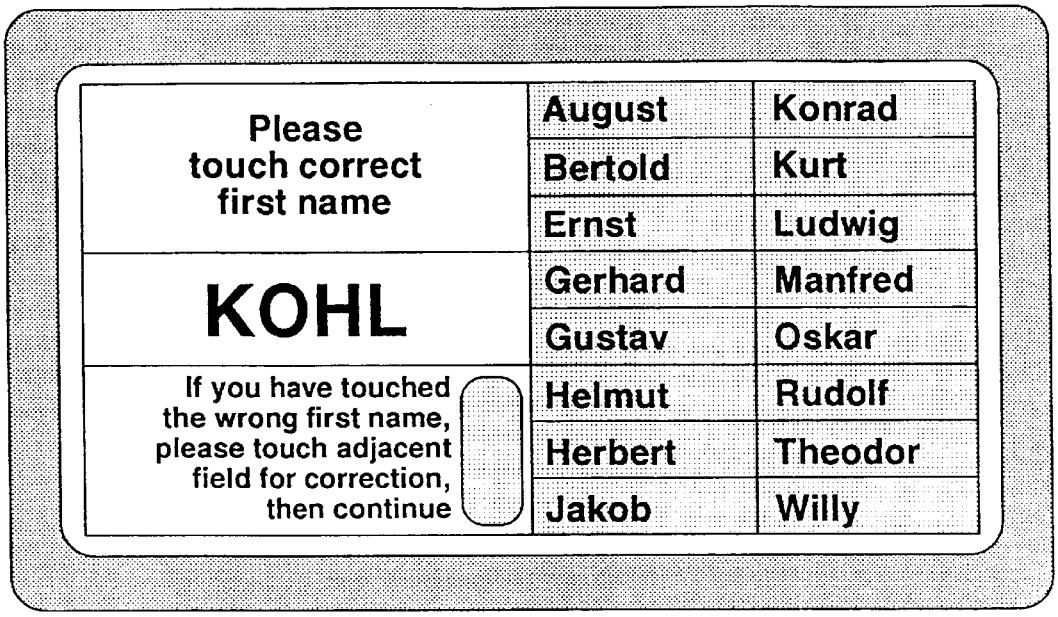
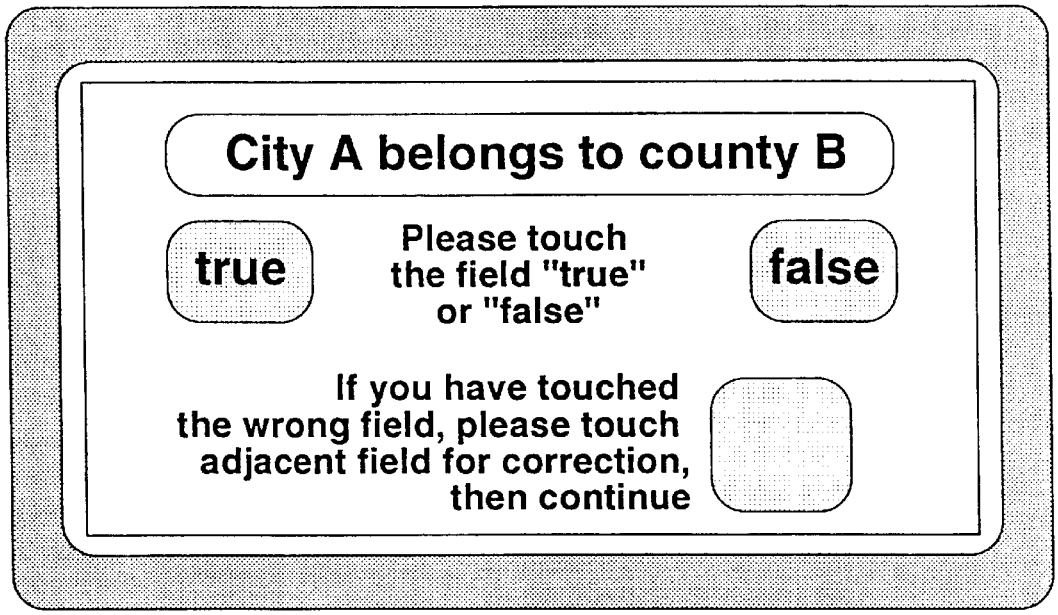
Figure 11 B

Figure 12 A
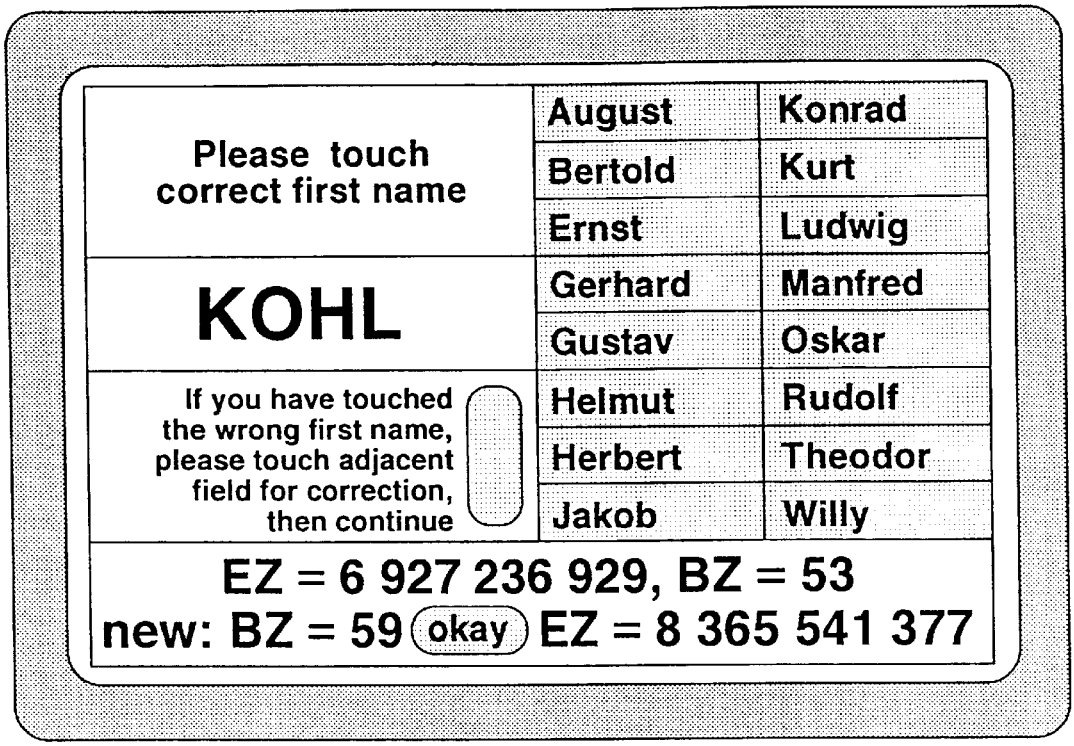
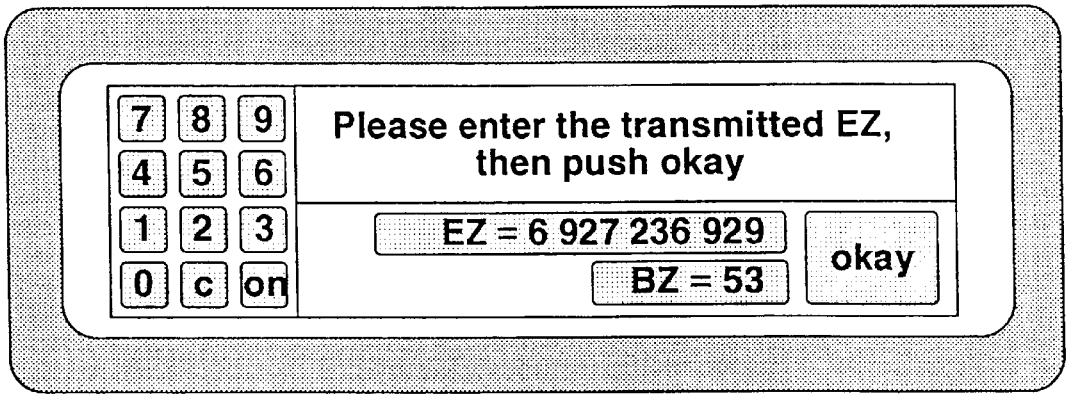
Figure 12 B

AUTHENTICATION METHOD

BACKGROUND OF THE INVENTION

1. Field of the Invention

The purpose of this invention is to provide an easily implementable method for authenticating a person's identity, which method is viable, falsification-proof and easy to apply.

2. State of the Art

There are essentially two known types of authentication method: the first type consists of equipping the person to be authenticated with a characteristic not specific to that person, for instance with a password, a microchip-card or a coded key. This characteristic is verified for authenticity by comparison with an identical or matching counterpart, checking for identity or for matching quality (lock and key system). For instance, anti-theft devices on cars can be disabled with a key containing a microchip, which exchanges a modified code with the motor control device after each use, as soon as the key is introduced into the ignition. only if the key and car ignition match, can the car be started. The disadvantage of this first type of authentication method is that third parties may acquire the person non-specific characteristic illicitly in order to take on a false identity without being detected. The need to memorize numbers or passwords as a characteristic is often not convenient because of human forgetfulness. Furthermore, third parties could get knowledge of these numbers and passwords during an authentication process.

The second type of authentication method relies on the principle of storing certain person-specific characteristics at a place remote from the person concerned. The proof of authenticity is made by comparison of the original characteristic with the stored counterpart. In the case of biometrical authentication methods, certain physical features, such as hand-geometry, finger-prints, photographs or physiological features (for example speech samples), may be used as person-specific characteristics. Biometrical methods are complicated, partially susceptible to falsification, and are often perceived as embarrassing by the persons concerned.

In the case of psychometrical authentication methods, certain psychological features, such as mental reactions or capacities, have been proposed as person-specific characteristics. For instance: character-traits, business and private projects, interests and opinions; a list of questions and answers; solution of one or more dexterity tasks; pattern recognition; or word association tests. These proposals are not practical or would suffer most of the drawbacks of password protocol: risk of mistaken responses, need for cryptographical protection of responses, repetitive guessing of responses by a persistent intruder.

The present state of the art is described in the following patent applications, patents or other documents:

PCT/US93/05357 (WO 93/24906): One or more questions from a list of questions stored on a card are displayed to a computer user. The user's responses are saved and compared with the correct answers stored on a card. Computer access is allowed if at least one user response matches a corresponding correct answer.

PCT/KR92/00056 (WO 93/09621): An electronic identification system consists firstly of a portable device, which is activated after entering a password, possibly in connection with the number of a car licence plate, an account or identity card number, and secondly of an automatically responding control station. For the purpose of user authentication or for creating a certain physical effect, signals and data trains which are verified in both units are exchanged by wireless transmission. In one arrangement, the input device is equipped with only four buttons, two of which serve for scrolling forwards or backwards through characters appearing on a display, a third one for marking certain characters, and a fourth one for correcting wrong markings.

DE-A-4 220 971: For the purpose of an identity check, the finger-print of a person is photographically registered, transformed electronically and stored, and used as an identification characteristic.

DE-A-4 125 870: Identification data of humans or animals are attached to a tooth in the form of an active medium, so that these data can be recognized in a non-destructive way at a later check-up.

DE-A-4 107 042: A tubule is incorporated in a living creature, for implantation of information-carriers by which the living creature can be identified.

DE-A-4 039 646: In the case of a biological object, measured values—for instance the electrical activity of brain or muscle—are recorded and compared with existing patterns of measured values. Start or cancellation of a process are related to the result of this comparison.

DE-A-4 036 025: Finger-prints are recognized with the help of a hologram.

DE-B-4 009 051: A characteristic temperature distribution of the face is used as a biometrical identification feature. The possibility of using person-related parameters, such as voice-specific features (the spoken word), height, shoe-size, the dynamic pressure path of movements, or the structure of the blood-vessels of the retina, as identification characteristics is mentioned.

DE-B-4 008 971: The user of a data-station is authenticated by passwords and random numbers via a one-way function.

DE-A-4 005 448: To search for a partner, personal data of a person, such as character-traits, business and private projects, interests and opinions, are stored in a station belonging to that person, then transmitted to an analogous station of a potential partner, then compared with corresponding data of that potential partner which he/she may have re-transmitted, and then evaluated with regard to the degree of conformity.

DE-A-3 943 097: Biometrically measurable data, for instance eye prints or finger-prints, are used as a key to accessing stored medical data.

DE-A-3 834 048 and DE-A-3 834 046: The finger-print of a person or an x-ray image of the finger-bone outline is used for optoelectronic identification of a person. The possibility of using additional measured values for identification, such as the form or outline of a nail, or of solving test problems, are also mentioned.

DE-B-3 827 172: Data are identified by transforming an input datum into an output datum—depending on preceding indications—according to the principle of transforming associated items of data, in which special branching patterns are applied. Data of any kind can serve as the basis for identification, for instance completely unknown, inaccessible, non-reproducible random data. The possibility of mutually exchanging data series between a data-carrier and a control station according to the challenge-response principle and of comparing those series with corresponding stored information series for the purposes of identifying persons, is mentioned, whereby the control station will emit a "good"-signal if the comparison is positive. Furthermore, a portable memory is mentioned, into which a personal secret identity number, an account number and other personal data are entered at the time of delivery to the owner.

DE-A-3 301 629: In an office telephone system, data are generated sequentially for each participant by a special switchboard; in order to identify a calling participant, such data contain information about the participant's address, number and the category to which he/she is assigned.

DE-A-2 846 974: A person is characterized by the solution of one or more dexterity tasks.

DE-A-2 254 597: Persons are identified by the following process: parts of the body having a characteristic curvature are recorded, stored in the form of a curvature graph, and evaluated with a data processing device.

DE-A-2 224 667: A key has a recognition register with several indicia-bearing elements; the latter can be placed independently in two positions, each of which carries indicia. According to the combination of the indicia-bearing elements, different patterns of indicia are generated, one of them corresponding to a pattern of the key arrangement which is only known by the key-owner and which permits unlocking.

DE-AS 1 762 669: In the case of data transmission, after establishing connection, the calling participant transmits two different characteristic qualifying signals, of which the second one is a coding of the first one. The other participant decodes the second signal and compares it with the first signal before the connection becomes operative.

DE-AS 1 195 057 and DE-AS 1 084 036: For the purposes of comparing persons, certain features of the face or of the entire body are measured or recorded, for instance the form of the ears, limit points of the temples, location of the pupils or of the nose tip, the middle line of the lips, the chin, particular wrinkles, cicatrices, birth-marks or warts. The use of poroscopy of finger- and palm-prints is also mentioned.

DE-B-683 233: In the field of pattern recognition applications, the distance between two particular points of an object, for instance of a hand-writing sample or of a body feature, is opto-electronically compared with the corresponding distance of a pre-existing pattern.

EP-A-0 573 245: In order to check the integrity of messages in a communication network between a plurality of participants, a so-called "authenticator" is assigned to each transmitted message, the authenticator being a code which is calculated in the emitting station from the entire information. In the receiving station, a comparison code is calculated from the received entire information with the same algorithm. Only when both codes are the same, is there certainty that the message was transmitted intact. Authentication of participants is achieved using secret and non-secret keys, and by different encoding functions and transmission steps.

EP-A-0 548 967: In the context of a data exchange system, mutual authentication is started by checking a personal characteristic, e.g. a codeword, entered by the user, after exhibition of an encoded dataword stored in the system which is only known by the user and which can be modified by him/her.

EP-A-0 532 227: In order to create secure connections within a cellular mobile telephone network, authentication signals are generated by a key-code which is conferred upon the user by the network operator and may be changed later on.

EP-A-0 522 473: Transmissions are generated between a person to be authenticated and a central authentication means, by exchange of certain secret and non-secret data in a communication network, as well as by exchange of questions and answers which result therefrom (challenge-response principle), which are transferred in doubtful cases to an arbitration means for renewed screening of the user's qualification.

EP-A-0 466 146: In order to guarantee that certain texts can only be read by persons who are qualified to do so, these texts or parts of them are composed of encoded signs which are stored in a memory and which can be decoded by the methods disclosed herein.

EP-B-0 441 774: An authentication card has several separate zones, one of which is dedicated to permanent storage in encoded form of a person-specific characteristic, for instance of individual features, such as finger- or foot-prints, signatures, etc., with the addition or subtraction of certain partial elements. The other zones are intended for temporary storage of the same characteristic without the additions or subtractions, for instance after taking a print of a finger or a foot, or by means of a scanning process during authentication. An automatic comparison of both characteristics is implemented in a card reader, after reconstitution of the image of the permanently stored characteristic using a code entered by the authorized user.

EP-A-0 382 410: In order to memorize and retrieve a password, its owner inserts the characters of this password into a plurality of alphanumeric texts according to a self-chosen pattern, in such a way that he/she alone is able to retrieve these characters with the help of the memorized pattern.

EP-B-0 085 680: A data-carrier, preferably a personal identity card, containing data about the owner, the issuing organization, account numbers, etc., is introduced into a reading device to transmit a release signal. For the purposes of additional authentication, the finger-tip of the owner is scanned by a sensor, recorded as papillary-line information, and compared with a counterpart already stored in the reading device.

EP-A-0 082 304: A person is identified by voice-recognition from of a characteristic sequence of voice features emitted during the utterance of a key-word, as well as by face recognition, e.g. by recognition of a specific part of it.

EP-A-0 034 755: An authorizing pattern consisting of characters and changeable by its owner is stored in encoded form in the recognition field of an identity card. This pattern generates a protocol during the reading of the card which has to coincide with an authenticity protocol for successful authentication.

EP-B-0 029 894: A key electronically imbedded in a personal identity card, which key is unchangeable and unrecognizable, is compared with a key in the possession of the person to be authenticated. The possibility of using signatures or dynamic signals during signature, as well as voice-records or finger-prints, as person-specific characteristics for authentication is mentioned.

EP-B-0 007 002: For the purposes of user authentication and for transmissions between a data station and a control unit, the former receives, combines, encodes and retransmits in a modified form certain user messages, and the latter receives these modified messages for comparison with stored information.

EP-A-0 006 419: Parts of the signature of a person are cryptographically recorded via certain keys, and decoded and verified for authentication.

GB-A-2 112 190: A combination of particular questions and their answers is used as information connecting a card to an original owner of the card. Questions and answers are selected by the original owner and registered in advance. The questions are displayed at the time of input of the card, and the user is asked to make answers to the displayed questions. These answers have to coincide with the registered counterparts.

GB-A-2 058 417: A code word is made up of a certain number of signs or symbols, which together with a number of other signs are presented to the user at least once, who makes his selection of the number of offered signs one after the other using a control part, the signs of the selection made being in agreement with his code word or parts of it.

Computers & Security, vol. 6, no. 6, 1987, Amsterdam NL, pages 464–470, XP 0000 50578, SMITH Sidney L. "Authenticating users by word association": User identity could be verified by a word association test. A new user is asked to provide the computer with a list of 20 cues (words or phrases) along with a response that the user associates with each cue. The computer stores these cue-response associations safely away. On subsequent access attempts, the computer selects a cue at random and challenges the candidate user to give the stored response, repeating that process as necessary to confirm the user's claimed identity. Depending upon an assessment of risk, a user might be required to give one response or several. Responses could be single words, such as surnames, first names of people, and place names.

SUMMARY OF THE INVENTION

The task of the present invention, i.e. to provide an easily implementable method for authenticating a person's identity, which method is viable, falsification-proof and easy to apply, is achieved by the authentication methods defined in the claims. In this context, associated ideas in the form of images, symbols, text or sounds, which are ideas based on the individual knowledge and experiences of a person, which are sufficient for the identification of that person and which consist of associated elements or of a principal part and a complement, are defined according to an appropriate terminology as person-specific psychometrical information, abbreviated as PSPI.

BRIEF DESCRIPTION OF THE DRAWING

FIG. 5 illustrates a static pin card used in the embodiments;

FIG. 7 illustrates data organization in an exemplary embodiment;

FIG. 9 shows an identity card of the embodiments;

FIG. 10 illustrates data organization for an exemplary embodiment;

FIG. 11A shows an authenticating device displaying names to be matched;

FIG. 11B shows an authenticating device of a question-and-answer type;

FIGS. 12A and 12B show an additional authenticating device and an associated terminal used in the embodiments.

DETAILED DESCRIPTION OF THE INVENTION

Figure 1:
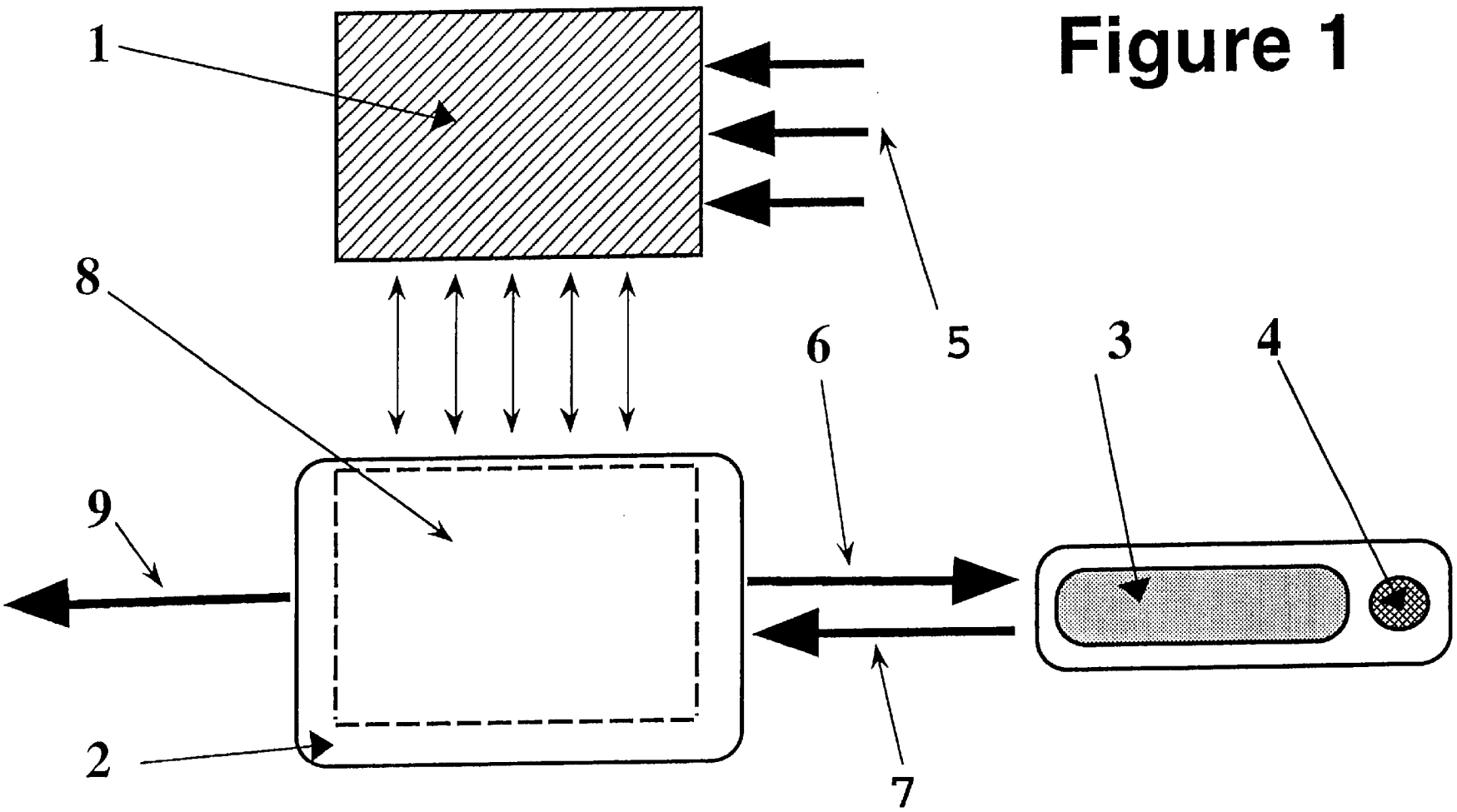
FIG. 1 illustrates a system of operation in accordance with an example of the embodiment.

Every human being is unique because of his or her own life, that is to say his or her own experiences and knowledge. Everybody is able to form thousands of original associations which cannot be produced by another person. Specific psychometrical experiments have shown that experiences, if they are remote in time, can be remembered particularly well if they are adapted to human thought patterns, and closely connected with persons, places, times and quantities.

Contrary to authentication methods where third parties try to demonstrate the identity of a certain person, the method according to the invention is methodically a self-identification, that is to say a method where the person concerned himself/herself demonstrates in the face of third parties that he/she is really a certain human being. Well-known didactic methods, such as "interactive learning" by computer, or "multiple-choice" tests, are completely alien to the method of the invention. Those methods rely on the principle that the learner or examinee has to reproduce common knowledge and not just an individual's PSPI.

The authentication method according to the invention is distinguished from other proposals by the possibility of using a large quantity of PSPI as an identification characteristic, if it consists of a principal part and a complement. PSPI benefits from the fact that it can be expressed and treated as bipartite patterns (preferably as pairs of written or spoken texts), in a particularly easy, clear and compact manner, thus with minimum investment in information units.

Therefore, the method according to the invention can be realized in a particularly economical and secure way, in distinction to the other methods.

If the PSPI is submitted for the purpose of identification to the process steps defined in independent claim 1, joint storage of matching associated elements is not necessary. In this case, groups of associated elements normally belonging to a common category are stored separately. only during the authentication process is the complete PSPI formed from matching associated elements, and assembled into characteristic patterns. It is therefore not absolutely necessary to protect the associated elements of the same category which are stored as groups, from unauthorized access. This feature reduces investment in protection measures: there is no need for cryptographic protection of stored responses and no risk of repetitive guessing of responses by a persistent intruder.

A special type of PSPI, advantageous for certain authentication purposes, is defined in the claims: Short statements which can be apprehended at a glance (in particular those which are either true or false) are especially appropriate for representing the principal part of a PSPI, while a symbol for "true" or "false" represents the complement. For instance, such a statement could be:

Principal part of PSPI: "Village A is located in county B", PSPI complement: "false".

Contrary to other categories of PSPI, e.g. questions and answers, statements are especially simple, as only two different complements are possible, namely "true" or "false".

Such complements are amenable to being entered very easily into the system, for instance by pushing only one or two corresponding function buttons. Verification of one single statement is, however, not sufficient for safe authentication: The probability of an unauthorized person accidentally pushing the correct button is 50%. Therefore it is proposed to verify a series of different statements rather quickly one after another, and to divide the total quantity of all stored statements preferably into 50% true and 50% false ones. Thus the chance of unauthorized persons accidentally pushing the right complement buttons is minimized. For instance, if there are ten statements to be verified, the probability of an accidental authentication is only $1/2^{10}$ or $1/1024$.

The authentication method according to the invention can be realized with existing simple and low-cost components. It has the potential of mass use in very different fields of application, such as:

Traffic technology: anti-theft devices;

Security technology: access control, equipment for surveillance and alarms;

Banking and trade: telebanking, electronic cash, personalized bank cards, productivity enhancement in the fields of check control and direct debit processes;

Communication and information technologies: authentication of participants;

Registration services: falsification-proof identity cards;

Cryptography: secret keys, notebooks, PIN-cards.

Particularly appropriate embodiments of the authentication method are described in the claims.

The claims define different characteristic matching schemes and arrangements of PSPI which consist of a plurality of associations of the type Ax-Bx-Cx, etc. These schemes and arrangements can be used as authentication criteria to be easily checked. In particular, it is advantageous to arrange the associated elements in the form of a matrix or of columns, and to attribute to them numbers (called "basic" numbers) BZ, from which for every arrangement A, a characteristic result number EZ can be calculated. The latter is, mathematically speaking, a function of all the basic numbers BZ and of their arrangement A:

$$EZ=EZ(BZ_1, BZ_2 \ldots BZ_n, A)$$

The function EZ can be defined by most different algorithms, for instance by:

$$EZ=\text{Sum of all } (I_x)^2$$

$$I_x=BZ_x \cdot BZ_{x+1} \cdot BZ_{x+2}$$

The basic numbers BZ are advantageously integers, and the function is preferably defined by an algorithm which delivers as result number EZ an integer having many digits. Further criteria for the choice of an appropriate algorithm are the following ones: easy implementation of the calculation, easy programming, and, finally, the impossibility of calculating the inverse function with only a limited investment of calculation and time.

The claims define convenient technologies, system components and functional processes for realizing the authentication method. If a large number of persons has to be authenticated, it is advantageous to supply each of them with an individual identity card, on which are stored the surnames and first names of people who are in the first instance only known by the owner of the identity card himself/herself, as well as basic numbers attributed to these names, and the corresponding result number. The matching of the surnames and first names is advantageously performed by means of an authentication device with touch-screen, into which identity cards can be inserted. A complementary authentication on the basis of other personal characteristics can be performed in addition.

The claims define a "tele-authentication" method with a pocket-sized authentication device which allows authentication by telephone. A simple and falsification-proof tele-authentication can be implemented by: calculating an original result number and a new result number from a modified set of basic numbers, transmitting the original and new result numbers and basic numbers, and comparing the new result number with another one which is produced in a data processing device. The pocket authentication device is also suitable for all kinds of on-the-spot authentication, for storing secret codes and PINs or other personal data in an undecodable manner.

The claims point to different advantageous security measures and processing facilities of the authentication method. For instance, it is possible to program the authentication process so that new acts of authentication with new PSPI are automatically initiated at irregular intervals. By these means, the presence of a certain person can be surveyed over longer time periods. It may also be convenient to exclude the possibility of authentication temporarily or indefinitely, by means of a time switch or an external signal. For certain applications, it is advantageous to update, replace or reproduce the stored PSPI, partially or wholely, whilst observing the necessary discretion. For design reasons, the devices for the storage and processing of the PSPI have often to be placed directly at the point of interaction with the person to be authenticated. The necessary miniaturization of these components is not difficult to attain, especially if intelligent chips are utilized: 200 statements in text form, each with about 25 characters, do not need more than 5 kB of memory. In the context of the invention's embodiments, an actuator is a device for the generation of a distinct mechanical, electrical, optical or other effect.

The subject of one claim is a miniaturized unit assembling all essential system components, having a very simple design and being easy to operate, which can be used as an electronic key in many fields of application.

The embodiment according to one claim allows mutual teleauthentication of two persons who have exchanged their respective identity cards.

Another claim defines another embodiment in which the PSPI of a plurality of persons is entered and stored in a central data bank, from where they are transmitted without their PSPI complements—for the purposes of authentication and if required or during certain time periods—to a decentralized control and one or more remotely operated stations having a display and an entering means for the PSPI complements. One advantage of this configuration is the fact that those to be authenticated do not need an identity card.

The principle of concentrating the PSPI of a plurality of persons in a central data bank can be combined with the principle of identity cards. Authentication relies in this case on two complementary stores of PSPI, the one stored in the card possibly being relatively small and interchangeable.

EXAMPLES

The invention and its embodiments are explained further in the light of the following examples and with particular reference to the attached FIGS. 1 to 13.

Example 1

Application of the authentication method to authorizing telecommunications

The task may be to exchange confidential data via fax between a person P1 at a site S1 and a person P2 at a site S2. Two preferably identical authentication devices, except for the stored PSPI, are placed at the sites S1 and S2. The device at S1 stores the PSPI of person P2, the one at S2 that of person P1. Both authentication devices may be connected via a digital communications network. Person P1 establishes contact with P2 by operating a signalling apparatus. The device at S2 transmits ten texts one by one from its memory to the device at S1, where P1 pushes the function button "true" or "false" after having checked each statement which appears on his/her display. After correctly identifying all statements as true or false, an actuator of the device at S2 signals the authenticity of person P1.

Hereupon, P2 initiates his/her authentication. This happens in the same manner as implemented by P1, except for the fact that it is no longer necessary to operate the signalling apparatus, because the connection is already established.

After P2 has correctly reacted to the ten statements, the mutual authentication is terminated, and the actuator of the device at S1 opens the connection for the exchange of faxes. The total authentication will be accomplished in about twenty seconds.

Example 2

Anti-theft device for cars

In recent years, car theft has become a big problem. Therefore it is becoming more and more common to install anti-theft devices or immobilizers in vehicles. Such devices simultaneously interrupt the starter, ignition system, injection or gasoline pump, and become automatically operative within about thirty seconds after locking the car. They can only be deactivated with a coded card or a coded key to start the vehicle. Professional car thieves are, however, not discouraged by such systems: simple bridging or disconnection of the cables renders these systems ineffective in a short time. On the other hand, traditional anti-theft devices are of no value in cases of car-jacking. The invention's embodiment redresses that situation.

The example concerns an automobile with two miniaturized memory-units which are addressed from the same terminal. The first memory-unit M1 may be mounted on the gasoline pump, the second one M2 in the upper part of the vehicle body. The terminal T may be incorporated in the dashboard and connected with M1 and M2 via preferably multi-core cables. M1 may directly affect the pump by means of an actuator, thus without intermediary electrical circuitry which could be short-circuited. In the locking position, the actuator keeps the pump deactivated, the pump drive turned off, and the gasoline supply interrupted. In the operational position, the actuator keeps the gasoline pump in operation. M2 may act directly, or likewise by means of an actuator, on a highly visible and obtrusive signal, for instance a metal arm which, in the locking position of the actuator, is embedded in the vehicle body, so that it cannot be seen from the outside. In the operational position, the metal arm is directed upwards. In the locking position, the metal arm deactivates the vehicle mechanically. It is convenient to attach an identification mark of the vehicle-owner to the arm in a clearly visible manner.

To start the vehicle, the driver has first to switch on the electrical supply of the car, in practice by a mechanical key system. By the same operation, the components M1, M2 and T are made operational. Next, the driver operates the signalling apparatus of T and thereby establishes contact to M1. M1 transmits ten stored statement-texts one by one to T, the display of which exhibits these statements. After the appearance of each single statement, the driver pushes either of the function buttons "true" or "false". If all the statements are correctly marked (which will take about ten seconds), M1 releases its actuator and with its help the gasoline supply. In a second step, contact with M2 is established, and the signalling arm is likewise put in operational mode. The entire system composed of M1, M2 and T is advantageously programmed in such a way that the actuators will return to their locking positions after the expiry of certain time intervals. Further operation of the vehicle is then only possible after a new authentication. The time intervals are preferably fixed by a device for the generation of unpredictable random series of control pulses. In order to ensure traffic safety, some time will elapse after each turning-off impulse, until the actuators return to their locking positions.

Example 3

Identity card with application-specific integrated circuit chip (abbreviated as ASIC)

According to FIG. 1, a relatively large quantity (e.g. 100) of PSPI statements is introduced (arrows 5), observing the necessary security measures, into the identity card 1 which has a one-chip microcomputer, and each PSPI statement is stored in it, with its complement "true" or "false". A memory volume of about 1 to 10 kB is needed for this storage. For mathematical reasons, an optimum is reached if half of the total number of the introduced PSPI statements is true, and the other half false. The internal structure of the card ensures that the stored PSPI cannot be copied without authorization.

The identity card can be put into an authentication device 2. By interaction between the two, a sufficient number of PSPI statements (e.g. ten) is randomly released without their complements one after another, preferably such that a subsequent PSPI statement appears only after complete processing of the previous one. It is, however, also possible to treat groups of PSPI statements simultaneously. The PSPI statements without complements are transmitted electronically to a display 3 (arrow 6), where they can be viewed. The card owner verifies or falsifies the PSPIs one after another, by means of a push button 4 which may be supplemented by a second one. Experience shows that not more than about ten seconds is needed for this operation. The PSPIs which are complemented in this way are sent back to the authentication device (arrow 7) and compared with the original PSPIs stored in the identity card (arrow 8). If this check is performed successfully, a release signal is transmitted (arrow 9). In the alternative, a stop signal is transmitted, preferably after finishing the comparison (arrow 9). In the case of a series of ten PSPI statements to be checked, the probability for a non-authorized person correctly verifying or falsifying all of the PSPI statements by chance is less than one in a thousand.

The ASIC comprises: a long-term memory for storing the PSPI and the program routines, a microprocessor for carrying out all of the necessary operations, in particular release of the PSPI statements without their complements in an unpredictable manner, serial comparison of these PSPIs when they are complemented with the originally stored entire PSPI, generation of the release and stop signals and of the security routines, as well as a sufficient short-term memory. It is possible to transfer part of these functions to the hard- and software of the authentication device.

For the example with an identity card just described and presented in FIG. 1, it would be possible, as an alternative, to get along with a far smaller store of PSPI statements (about ten) instead of the roughly one hundred PSPI stored in the form of statements, and still guarantee sufficient security: only a few PSPI statements (e.g. two) would have to be extracted from this store per authentication if PSPI in the form of question plus answer or in the form of text fragment plus missing text were used. However, for this alternative it would normally be necessary to provide an alphanumeric keyboard, by itself complicated and expensive, instead of the input push-button of FIG. 1.

Example 4

Memory-unit with actuator

Figure 2:
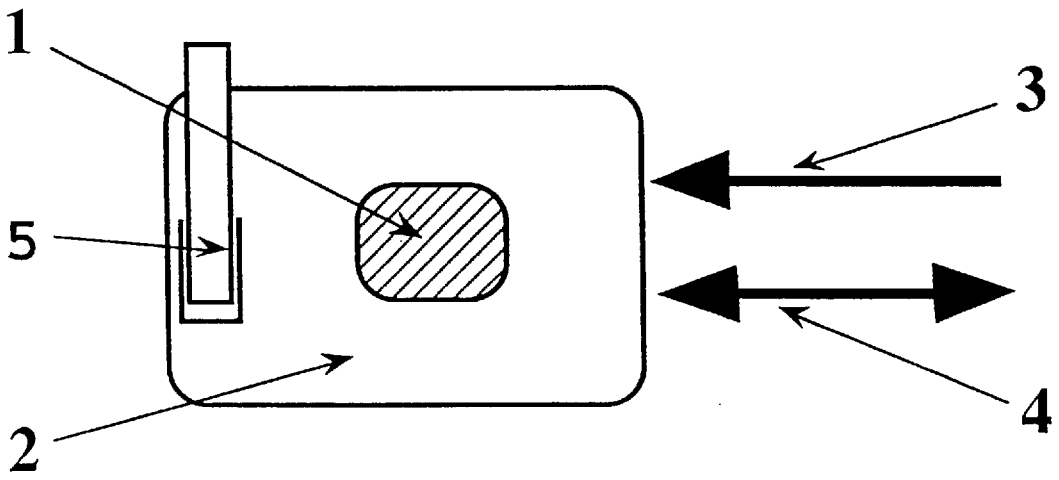
FIG. 2 shows the integration of an ASIC into a casing of FIG. 1.

FIG. 2 shows schematically how the ASIC 1 is permanently incorporated into a fixed unit 2. This unit is equipped with a power supply 3, an electronic connection 4 to the remotely located display (which is not shown), and with an actuator 5. This configuration is suited to serve as an electronic anti-theft device for vehicles, especially with the inclusion of the time factor according to claim 7.

Example 5

Active identity card

Figure 3:
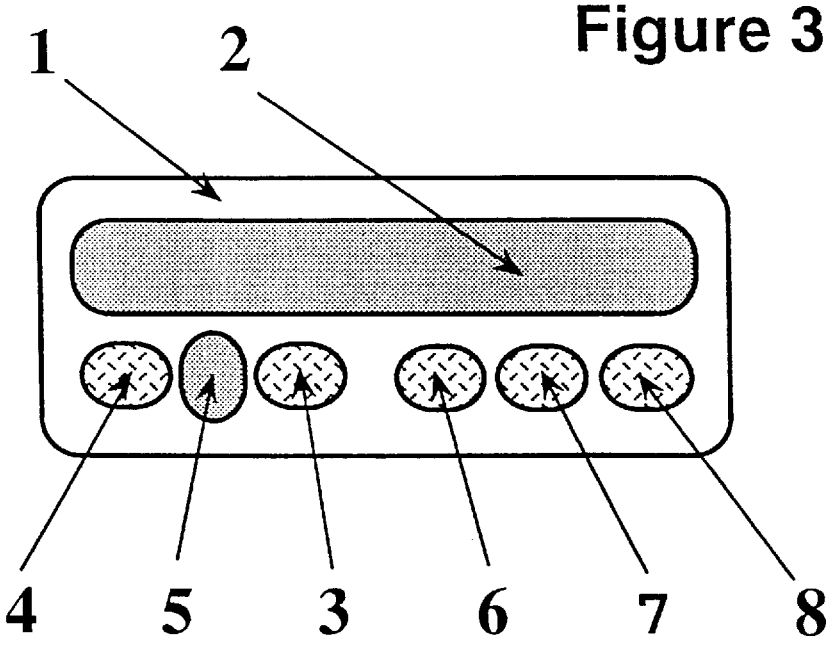
FIG. 3 shows a miniaturized authentication card used in the embodiments.

FIG. 3 shows a miniaturized unit, such as an active identity card, which combines all of the components and functions of an authentication system. The casing 1 with dimensions of 10 cm×4 cm×0.8 cm as an example, possesses a two-line main display 2 for viewing the PSPI without complement, the introduced complements, and other texts. In the light of International Patent Application PCT/KR92/00056 (WO 93/09621), the keyboard can be reduced to a few buttons even in the case of alphanumeric input: the button 3 (up) initiates forward- and the button 4 (down) backward-scrolling of alphanumeric characters appearing on the auxiliary display 5. The identity card is turned on by button 6 (on), and the first PSPI statement without complement appears on the main display 2. The button 7 (set) serves for the input of the relevant character into the auxiliary display, the button 8 (cancel) for cancelling incorrect inputs. The result of the authentication process is viewed on the main display and enables the performance of certain further operations, if it is positive.

A miniaturized authentication device of this kind can be used in numerous applications, for instance:

a) as a crypto-notebook: Personal information, such as secret codes, account numbers, etc., can be entered with the provision that they can only be reproduced after successful authentication;

b) as a falsification-proof identity card: Only the owner of the device is able to perform his/her authentication; and c) as a key for access to otherwise restricted localities, plants, machines, vehicles, or data systems. After successful authentication, an open signal will be available.

In case c), it is convenient to suit the outer form of the device to the key function. Such an electronic key can be programmed, as an example, so that codes, passwords or information chains which are stored in the device and which may be time-dependent can be sent to the lock after successful authentication, via contacts or other means not represented in FIG. 3. The codes, passwords or information chains conform chronologically with their changing counterparts in the lock. The program may also initiate a temporary or permanent deactivation of the key.

The time-dependence of the codes, passwords or information chains in key and lock can be realized in many ways. For example, the digits $z_x$ of a code-number can be recalculated at regular or irregular time intervals, each digit resulting from a distinct time-dependent function which may be changed after a predetermined time interval or by signals emitted from the outside. Such a time-dependent function is defined, for example, by the formula:

$$z_x = \mathrm{Mod}[\mathrm{Int}\{\mathrm{Sqrt}(n+a_x)\},10]$$

$z_x$=integer number between 0 and 9

Mod=modulo-function

Int=integer-function

Sqrt=square-root-function n=number of time-units passed $a_x$=constant value

The constant value ax has a different value for each digit of the code number and can itself be time-dependent. For reasons of security, it may be convenient to conceal the stored codes, passwords or information chains and their time-dependence from the key owner .

Example 6

Authentication matrix

Figure 4:
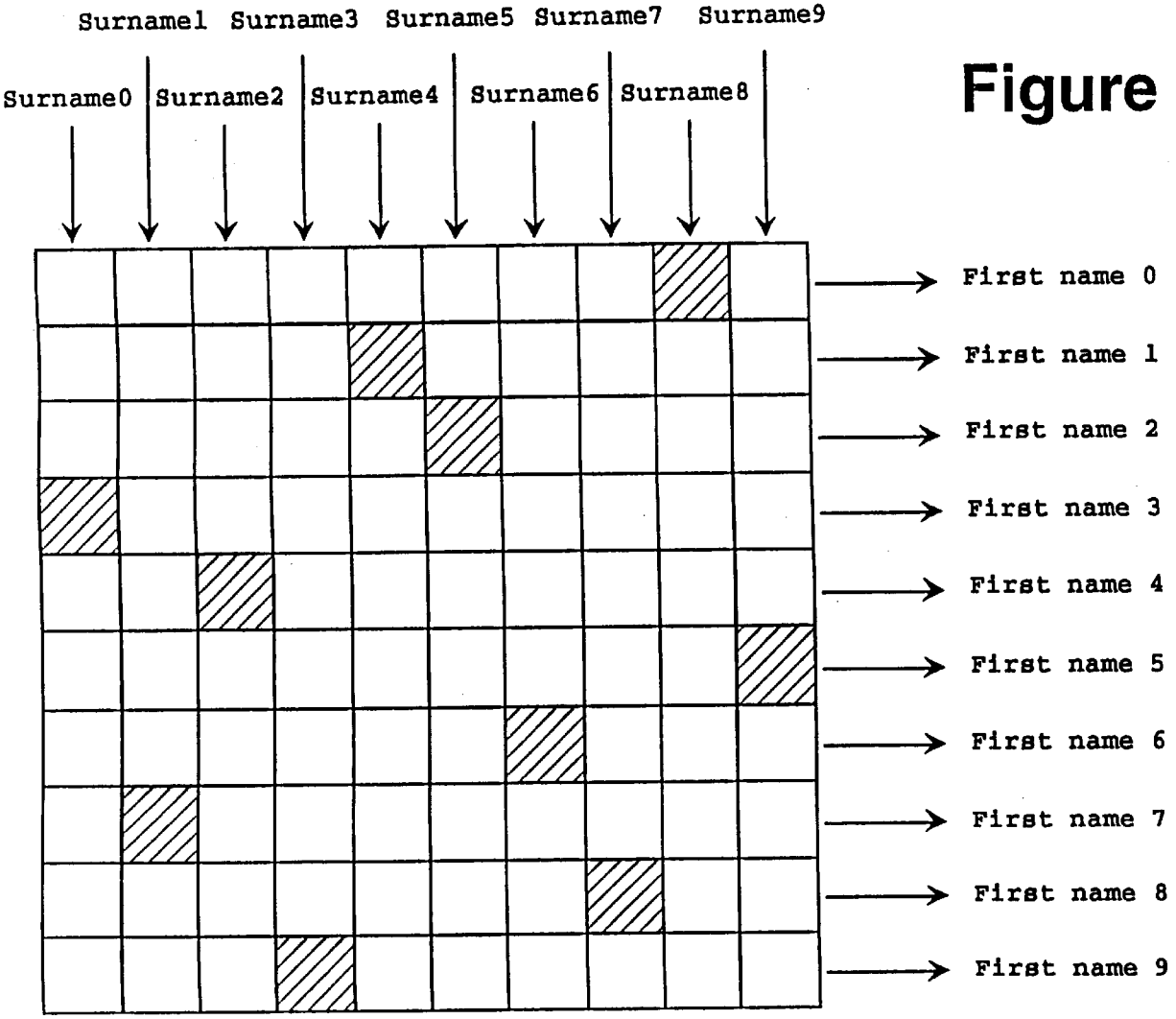
FIG. 4 illustrates an exemplary embodiment of an authentication matrix.

According to FIG. 4, encoded electronic information is entered along one axis of a chess-board-like field via a ten-bit-wide databus. The encoding principle consists in a thorough-going re-arrangement of the conducting wires of the bus (the conducting wires may be numbered as LAx at the matrix input and as LEx at the matrix output). The following a ssignment is implemented in the example: LE0-LA8, LE1-LA4, LE2-LA5, LE3-LA0, LE4-LA2, LE5-LA9, LE6-LA6, LE7-LA1, LE8-LA7, LE9-LA3. Each one of the ten conducting wires of the databus is marked with the surname of a person. Along the other axis of the matrix, the information is passed on likewise via a ten-bit-wide databus. The ten output conducting wires are marked with the ten correlated first names of the persons, in such a way that a scrambled sequence of first names is formed, if the surnames are passed one after another.

Each input wire can be connected with every output wire within the matrix. Decoding of information is implemented by re-arranging the w ires in the matrix in such a way that each input wire is correctly matched with its correlated output wire, in the example: LE8-LA0, LE4-LA1, LE5-LA2, LE0-LA3, LE2-LA4, LE9-LA5, LE6-LA6, LE1-LA7, LE7-LA8, LE3-LA9. The hatched fields in FIG. 4 indicate the combination points for correctly associated surnames and first names. The person to be authenticated creates the ten correct contacts between the wires of the input-bus and the output-bus, by pushing buttons or by similar action on these fields. In total, there are 10! possibilities for matching the two data-buses within the matrix. Only one of them is the correct one, and therefore suitable to decode and pass on the fed-in information.

The principle of the authentication method described in this example and outlined in FIG. 4 can be physically implemented in many ways. For instance, the two-dimensional pattern consisting of the ten nodal points can be used as a mechanical or electronic key which matches with a lock not recognizable from the outside. It is also possible to attribute signs or numbers (basic numbers) to all matrix fields, so that the signs attributed to the nodal points may serve as secret codes. Alternatively, the corresponding basic numbers may be fed into a calculation algorithm in order to calculate a result number which is characteristic for the pattern.

Example 7

First Passive PIN-Card

According to FIG. 5 and with a view to reproducing secret codes (PINs), the owner of the card shown first produces ten pairs of surnames (surname 0, surname 1, etc.) and associated first names (first name 0, first name 1, etc.) of persons who in principle are known only to himself/herself. In FIG. 5, surnames and first names with the same digit are not correlated. The surnames and first names are arranged on the card or on data-carriers attached to the card in such a way that pairs of surnames and first names which belong together are placed in both columns in the most random manner. Then the card owner defines (in the example) five PIN-codes (C0, C1, C2, C3, C4), or takes note of already existing codes, each of which may contain up to ten characters. A digit or character (z00 to z49) of each of the five PIN-codes is compared with each first name on the card or entered into the data-carriers on the card, in five columns of digits or characters, in such a way that the first code digits or characters are placed beside that first name which belongs to the first surname, the second code digits or characters beside the first name which belongs to the second surname, and so on. If a code has less than ten digits or characters, digits or characters of any kind are inserted after exhaustion of the store of digits or characters of the code. For the purposes of authentication, the card owner associates one after another of the surnames with the first names, and gets one by one from the relevant column the code digits or characters which are placed beside the first names.

Example 8

Active PIN-Card

Figure 6:
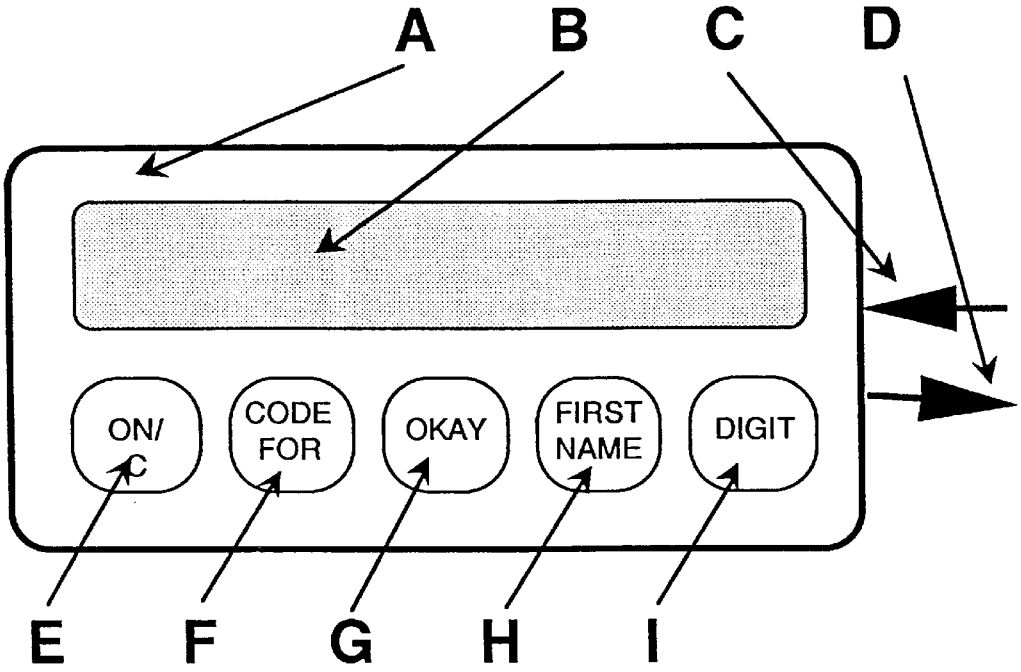
FIG. 6 shows a secret card of the embodiments.

According to FIG. 6, the surnames and first names of persons are used as associated elements Ax and Bx. A display B and several processing buttons are located on an electronic security card A, called here an active PIN-card. For example, the following buttons may be available: E for "on/off", F for scrolling through the code denominations, G for "okay", H for scrolling through the first names, I for exhibiting the desired entire code. The arrow C symbolizes the input of information to be stored: Surnames, first names, code denominations, characters or digits. The characters or digits are a function of the first names and the code denominations, the order in which the surnames are displayed depending on the code denominations. For instance, the identity card may be "loaded" by insertion into a loading device, by incorporation or programming of an intelligent chip, or by connecting it to a keyboard or a personal computer. Arrow D indicates the possibility of utilizing a code which is generated during the authentication process, for unrecognized authentication as in the case of a coded key.

For the generation of a PIN, the device is switched on, and the desired code denomination is entered by scrolling and operation of the "okay" button. Thereafter, the surnames appear one after another on the display. By scrolling through the first names and operation of the "okay" button, the correct first name is entered. Simultaneously the device memorizes the correlated code digit or character or displays it in the display. The entire code is thus reproduced in a stepwise fashion.

Example 9

Second Passive PIN-Card

According to FIG. 7, ten text-pairs Ax-Bx, composed of ideas known only to the owner, preferably surnames and first names, are inscribed on a card or sheet in two text columns in such a way that correlated surnames Ax and first names Bx are separated from each other in a highly randomized manner. For the purposes of illustrating the principle, the surnames and first names of contemporary personalities are used in FIG. 7, which, of course, do not satisfy the fundamental psychometrical criterion of the invention of exclusive individual knowledge.

Between these two word columns, eight double columns of indicia are arranged, preferably of letters and digits, from which eight secret codes (PIN 1 to PIN 8) can be derived. In these central indicia columns, digit codes are labelled PIN 1 to PIN 5, and letter codes are labelled PIN 6 to PIN 8.

To reconstruct the eight codes, the card owner associates the surnames with the first names (which in real cases are known only to himself/herself) one after another as indicated in the left parts of the double columns by letter or digit series, and then by following the lines of the first names comes in the right parts of the double columns to the digits or letters forming the secret code. In the example, the following codes will result: PIN 1=36 29; PIN 2=29 26; PIN 3=27 305; PIN 4=69 11 37; PIN 5=57 06 27 98 18; PIN 6=EGM ZUC; PIN 7=GQA REH DZ; PIN 8=AHO SUW DI BQ.

Example 10

Personalized electronic key

Figure 8:
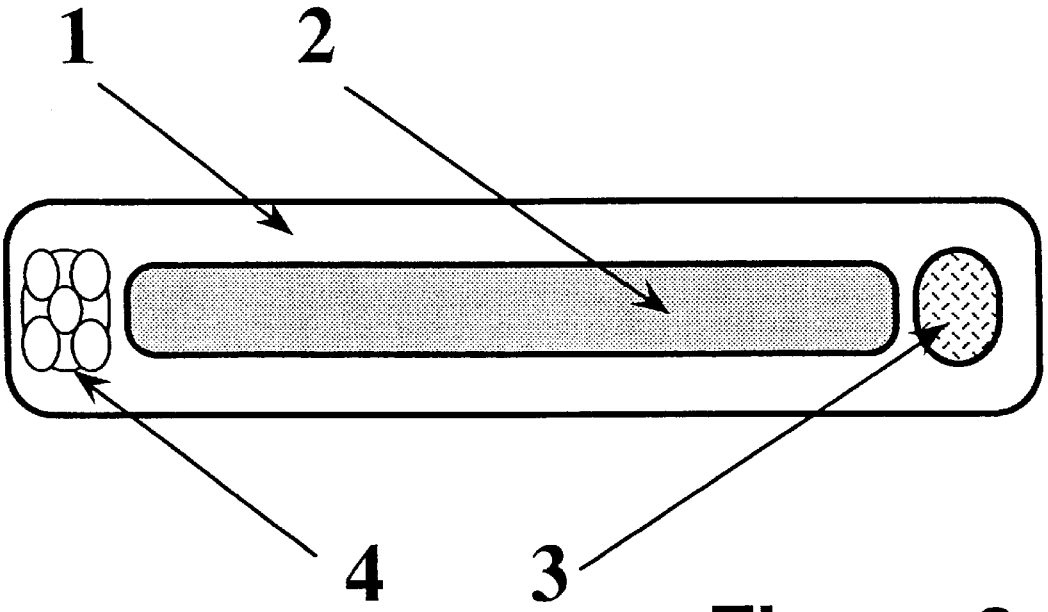
FIG. 8 shows a personalized electronic key of the embodiments.

According to FIG. 8, a display 2 is incorporated in an elongate plastic casing 1, on which display up to about 25characters can be exhibited in a single line. By pushing button 3, short statement texts are displayed one after another, in particular combinations of names, which are to be verified by the key owner, for instance by twice-repeated pushing of the button. After a set number of verifications, an electronic signal becomes available for a short time via the contacts 4 which generate the intended effect after putting the key in a suitable electronic lock.

The electronic circuitry of the incorporated ASIC consists essentially of a memory of about 500 to 1500 bytes and a processor for the release, display and comparison of the stored texts, as well as for the input, storage and time-dependent generation of the unlocking signal. A keyboard which is separate from the key, serves as an input device for the texts and, if needed, of a modified electronic signal. The key is connected to the keyboard to "load" the key. In order to activate the key effect, the key is put into a corresponding electronic lock.

The main advantages of this personalized electronic key are:

a) Only the key owner is able to activate the key. He/she need not memorize any code or secret number. Nobody can forge the key.

b) The texts used for verification, and the signal, can be changed.

c) The key is suitable for a wide range of applications, for instance as an anti-theft device for cars, for controlling access to rooms and apparatus, in general for all cases where non-personalized keys are now being used.

d) Simple design with existing components.

Example 11

Identity card

Fifteen text pairs (A1-B1, A2-B2, . . . A15-B15), logically belonging together, are noted in two columns of the identity card according to FIG. 9, correlated pairs Ax and Bx being randomly separated as far as possible. The matching of all the texts follows the scheme A1-B1-A2-B2, whereby A(x+1) is placed on the same line as Bx. The first fifteen prime numbers are arranged between the two text columns as basic numbers, one after another.

Ideas known only to the owner of the identity card are advantageously used as text pairs, such as surnames and first names of persons, names and business of persons, names and denominations of localities, names of neighbouring villages, denominations and characteristics of locations, and so on.

The fifteen basic numbers BZ are brought into a particular order by the above-mentioned matching scheme for the texts. In total, there are $14! \approx 8.7 \times 10^{10}$ different orders. It is therefore impossible to guess the order chosen for the identity card, and pointless for reasons of time and cost, to inversely calculate the order starting from the result-number. This is particularly true if one keeps the calculation algorithm secret, that is to say if one does not note it on the card.

Fifteen intermediary results $N_x^2$ are calculated by the algorithm shown in FIG. 9, via the operations:

$$N_x = BZ(A_x) \cdot BZ(A_{x+1})$$

and the power-exponent 2, for each order of basic numbers. The final result number EZ is found by addition of the fifteen intermediary results, in the example EZ=2 042 071 872.

It is obvious to use other matching schemes, other basic umbers, and other algorithms for calculating the result umber.

The identity of the card owner will be demonstrated at a given time and a given location by re-calculation of the result number EZ. For this purpose, an elementary pocket calculator is sufficient. It is also possible to use a specially programmed calculator, into which the fifteen basic numbers are entered one after another, and which outputs the result number directly. In this case and in the following one, the description of the algorithm on the card can be dispensed with. It is even more advantageous to use a card reader (in other words, an authentication device), on the display of which texts and numbers are shown after introduction of the card, and on which the card owner can match the texts (and numbers) on the assumption that a program contained in the reader will automatically calculate the result numbers.

In order to speed up the identification process in the case of institutions where a large number of people needs to be received at counters and cashdesks, for instance in banking for check-confirmation, in trading for automated debiting and for electronic cash, it is convenient to remotely locate the authentication device. The basic and result numbers of the identity card will be transferred by the authentication device into a short-term data-carrier (so-called electronic money) which can be evaluated by a reading device placed near the counter or the cash-desk. After a pre-determined time or if initiated by the reading process, the data temporarily entered in the data-carrier will be automatically cancelled.

If authentication is to be effected by a remote means, it is possible to enter and transmit the result number, and the basic numbers in the correct order, by means of the common and widely available numerical keyboards of existing communication networks, observing appropriate security measures. In the example, it would be necessary to enter ten digits for the result number and fifteen two-digit numbers for the basic numbers. This does not require more effort than establishing an international telephone connection.

In order to improve security, the authentication can be subdivided into two or more steps, that is to say one can perform several identifications with the same identity card or with different cards, in a time-staggered manner. For instance, it is possible to use two cards which are nearly the same and which differ only by a very small rearrangement of the texts. If somebody managed to discover the first identification process, he/she would not be successful in attempting authentication, as he/she would not be conscious of the fact that there was a second card differing from the first one.

The main advantages of the identity card just described are:

- No secret numbers or reference patterns are needed for identification, as is the case for the finger-print method. The risk of unauthorized access to these patterns or codes no longer exists.
- Direct readability of the cards, if the PSPI and the numbers are visibly printed.
- Simple design and inexpensive production.
- In appropriate instances, no need for troublesome electronics.
- Secret numbers or codes need not be memorized.
- A sufficiently large number of texts, the use of several columns of basic numbers, the concealment or modification of the algorithm, or the subdivision of the identification process into partial steps will make the process as falsification-proof as desired.

Example 12

Authentication with identity cards

According to FIG. 10, each identity card contains, assembled in groups, the surnames and first names of sixteen people who are known only to the card owner. (For the sake of illustrating the principle, the surnames and first names of contemporary personages are used which, of course, do not fulfil the fundamental psychometrical criterion of the invention of exclusive individual knowledge.) A prime number (basic number BZ) is attributed to each name. The matching is as follows: ADENAUER-Konrad-BRECHT-Bertold-ERHARD-Ludwig, etc. Altogether there are $\mathbf{15}! \approx 1.31 \times 10^{12}$ different matching possibilities. The algorithm is defined as: result number $EZ = \Sigma(Z_x)^2$, where $Z_x$ is defined as $BZ_x \cdot BZ_{x+1} \cdot BZ_{x+2}$. The result number in this example is calculated to be 6 927 236 929.

The authentication device (FIG. 11A) displays on its touch-screen the surnames and first names as well as menu-indications.

In order to prevent an owner of an identity card from transferring without authorisation his/her card and his/her psychometrical knowledge to another person who might attempt to perform a forged authentication, it is convenient to accomplish in addition to the authentication according to the matching principle, an additional authentication on the basis of the characteristic-comparison principle. For instance, PSPI statements or biometrical characteristics of each participant in the system may be stored in fixed information memories, with the help of which corresponding data produced during authentication can be compared.

FIG. 11B shows how an authentication device with a touch-screen already used for carrying out authentication according to the matching principle, can also be used for verifying PSPI statements, that is for authentication according to the characteristic-comparison principle.

If biometrical characteristics are used for this additional authentication, very simple features, such as height, weight, head circumference, etc., can be utilized, because it is only necessary to demonstrate that a person does or does not differ physically from another one.

Example 13

"Tele-authentication" by telephone

According to FIG. 12A, the person to be authenticated uses an authentication device with a touch-screen and identity cards (which are not shown) with 16 surnames, 16 first names and 16 basic numbers, for instance the first 16 prime numbers from 2 to 53. If no authentication device is available, a simple card with the corresponding information which is directly readable, and a pocket calculator with a 12-digit display will suffice. The use of a newly shaped authentication device in the form of a small electronic calculator (FIG. 13) is, however, especially appropriate, as will be described in Example 14.

After introducing an identity card, the picture represented in FIG. 12A will be displayed on the touch-screen. The screen possesses in its lower part a display for exhibiting the result number EZ=6 927 236 929 which is calculated after matching all surnames and first names, and for exhibiting one of the basic numbers attributed to the names, in the present case, BZ=53.

The authentication device is equipped with means for generating numbers which can be used as a modified basic number and which will be displayed on the left side of the lower part of the screen (in the example BZ=59). This new basic number will be used instead of the original one (BZ=53). After touching the "okay" field, the authentication device calculates the new result number EZ=8 365 541 377. Initially, the four numbers remain visible. Next, the person to be authenticated calls the authentication means, and communicates the original EZ=6 927 236 929 and the original BZ=53. The authentication means has access to a data processing device via a terminal. All persons participating in the authentication system have been entered in it before the beginning of its operation and observe the necessary security provisions, their result number, chain of basic numbers and possibly additional basic numbers attributed to the surnames and first names, as well as in appropriate instances individual algorithms. This data processing device has a program performing the following processes: After input of a correct result number into the terminal, first the corresponding chain of basic numbers will be addressed; then a basic number will be entered into the terminal, so that—if that basic-number was correct—its corresponding basic number in the chain is identified and activated. The program then calculates the new result number automatically, according to a user-specific algorithm or on the basis of an algorithm common for all participants, from the addressed chain of basic numbers, or replaces the identified basic number by another one which was entered in the terminal.

The display of the terminal of the authentication means is shown in FIG. 12B. It has a keyboard (fields) for entering the ten basic digits, a cancellation button (field) "C" and a turning-on button (field) "on", as well as a domain for indicating the user-led menu. Finally a field for displaying result and basic numbers, and a button (field) "okay".

After turning on the terminal, the user-led menu exhibits "Please enter the transmitted EZ, then push okay". The operator at the terminal then enters the original EZ=6 927 236 929 and observes the result on the display, after which he/she operates the field "okay". By this, the chain of basic numbers of the person to be authenticated present in the data processing device is addressed and activated. Then follows the menu indication "Please enter the transmitted BZ, then push okay". The operator complies with this indication by entering the BZ=53 and operating the field "okay". This basic number is identified and activated in the data processing device, and the menu exhibits the request "Please request the new basic number, then enter it, then press okay". The operator formulates the corresponding request on the telephone, receives from the person to be authenticated the new BZ=59, enters it into the terminal and confirms with the field "okay". Thereafter, the data processing device calculates the new result number EZ=8 365 541 377 and exhibits it on the display. Then follows the menu indication: "Please request the new result number and compare it with the one exhibited on the display, then press okay". The operator, after having transmitted the corresponding request by telephone, receives from the person to be authenticated the new EZ=8 365 541 377, compares it with the one on the display, and confirms in the case of a positive result with the field "okay". The display thereafter exhibits "Authentication successfully accomplished". If there is no conformity, the authentication process is abandoned.

The new chain of basic numbers with the new BZ=59 remains stored within the authentication device of the person to be authenticated as well as in the data processing device. Furthermore the new EZ=8 365 541 377 remains in the data processing device as an access criterion for the chain of basic numbers. The time and progress of every authentication attempt are recorded for surveillance purposes. The data processing device is programmed in such a way that each basic number of the chain can only be modified once. If after a number of acts of authentication all original basic numbers of a chain have been changed, the person to be authenticated uses a completely new set of basic numbers, either having the same matching order as another one already available in the data processing device, or generated in it at the necessary moment, and which replaces the preceding chain of basic numbers after the last modification of an original basic number.

The telephone authentication method according to this embodiment of the invention is absolutely falsification-proof. The investment in communication time is minimized, because only two ten-digit and two two-digit numbers have to be transmitted.

Example 14

Pocket authentication device

Figure 13:
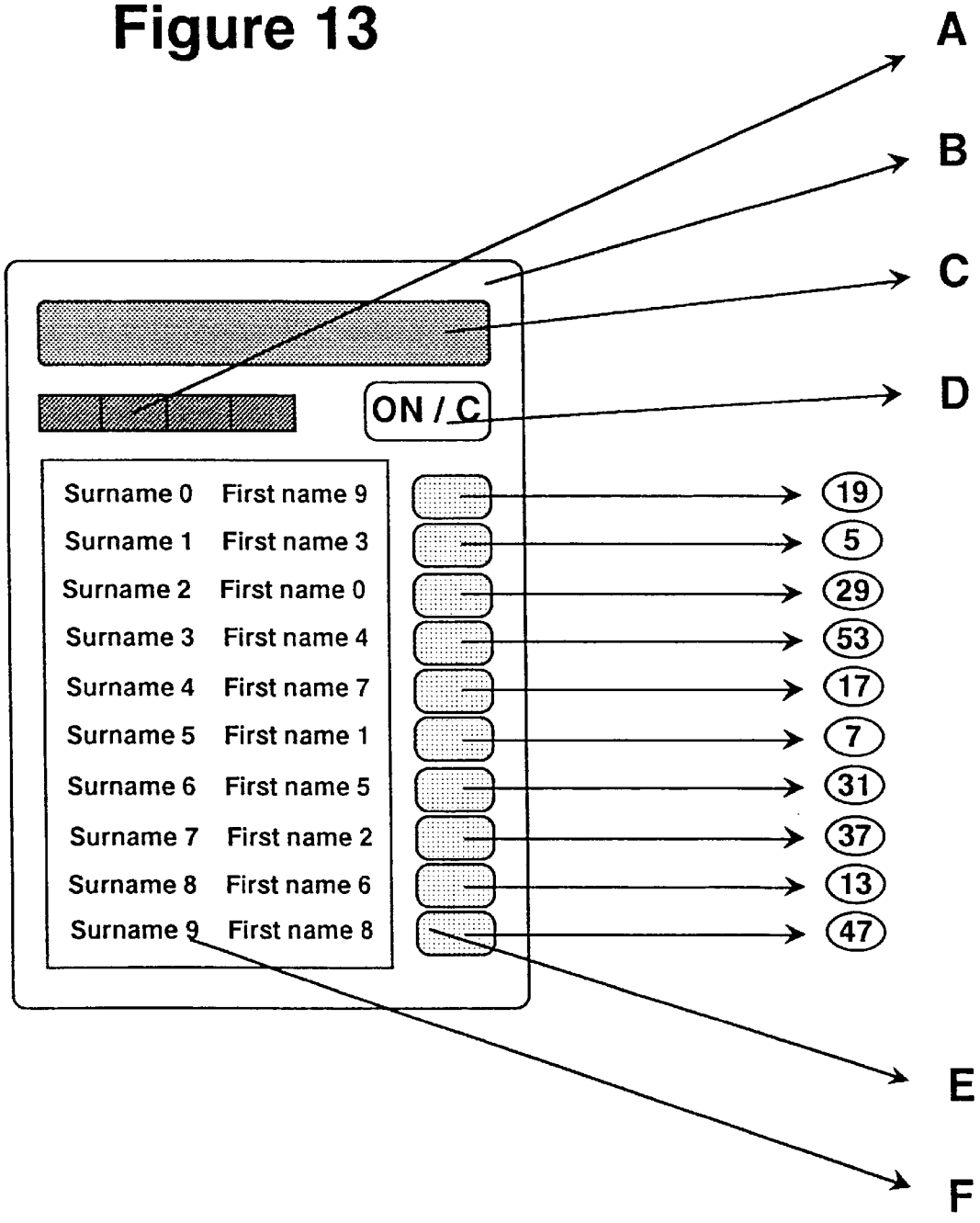
FIG. 13 shows a pocket authenticating device for telephone authentication.

Regarding FIG. 13, a handy authentication device composed of elementary components is described, by the use of which the person to be authenticated can perform the main steps of telephone authentication quickly and without error. This device is also suited for all kinds of on-the-spot authentication and for storing secret codes (PINs) and other personal data.

Identified in FIG. 13 are: B a casing, A photocells, C a 12-digit display, D a switch for turning on and off the device and for initiating special functions, E a column of ten push-buttons or release fields, F an area on which are inscribed ten surnames and first names of persons who have been chosen by the owner of the device according to the criteria of the invention. The ten buttons or fields are electronically covered each by a basic number, as is shown in FIG. 13. As was already mentioned in Example 12, additional basic numbers which are not shown, may be attributed to the buttons or fields in the manner described in the claims. Further features of the device result from the claims.

The authentication process progresses as follows:

1. The owner turns on the device, after which the last calculated result number appears on the display. Thus according to FIG. 13, EZ=3 056 775 706, if the algorithm was chosen as $EZ=\Sigma Z_x$, with $Z_x=BZ_x \cdot BZ_{(x+1)} \cdot BZ_{(x+2)}$.
2. He/she operates one after another the ten buttons (fields) following the matching scheme. The EZ=3 056 775 706 appears once again on the display. This means self-authentication of the owner who may then continue by noting this result number.

3. He/she pushes the button (field) beside 'surname 6 and first name 5', until the basic number BZ=31 appears on the display. He/she notes this basic number.
4. He/she pushes the same button (field) again, as long as a new basic number appears on the display, in the example BZ=33. This new basic number was generated by the owner with the means revealed in the claims, or automatically by the authentication device. He/she notes this new basic number.
5. He/she repeats step 2, and gets the new result number EZ=2 891 394 442 on the display, which he/she notes.
6. He/she transmits the four numbers 3 056 775 706, 31, 23, and 2 891 394 442 by telephone to the authentication means which then accomplishes the authentication process by the means revealed in the claims.

The owner can exhibit possible stored secret codes (PINs) or other personal data on the display, after each successful self-authentication, with the pocket authentication device and with the help of the further features mentioned in the claims. The number of possible acts of tele-authentication is practically unlimited, because: first the quantity of basic numbers needed for authentication is only limited by the memory volume of the authentication device, and secondly the authentication device can be loaded with fresh data from time to time, observing certain security measures.

What is claimed is:

1. An authentication method in an information technology device having a fixed and a portable data-carrier, an intelligent chip, means for entering, storing, programming, processing, random release, comparison, transmission, and display of information, as well as a means for signal processing and an actuator, the method comprising the steps of:

(a) constituting a plurality of associated ideas (PSPI) as constitutive elements in the form of images, symbols, text or sounds, said associated ideas (PSPI) being based on the individual knowledge and experiences of a person and being sufficient for the identification of that person, and storing said ideas;

(b) storing in the storing means the constitutive elements of the PSPI in a plurality of element groups such that the elements of a first group are placed in a determined sequence and the elements of the remaining groups are placed in a random sequence;

(c) adding numbers or letters to the constitutive elements of the stored PSPI by means of the device;

(d) displaying on the displaying means the elements of the first group in a determined sequence and the elements of the remaining groups in a random sequence;

(e) putting together the PSPI elements into a characteristic geometrical pattern of reconstituted PSPI, by connecting associated elements of the respective element groups;

(f) generating a code, the code depending on the numbers or letters and their position in the geometrical pattern; and (g) comparing the code with a code permanently stored in the device.

2. An authentication method in an information technology device having a fixed and a portable data-carrier, an intelligent chip, means for entering, storing, programming, processing, random release, comparison, transmission, and display of information, as well as a means for signal processing and an actuator, the method comprising the steps of:

(a) constituting a plurality of PSPI, each PSPI consisting of a statement and its corresponding truth value (true/false), about half of the statements being true and the other half being false relating to constitutive elements in the form of images, symbols, text or sounds, said associated ideas (PSPI) being based on the individual knowledge and experiences of a person and being sufficient for the identification of that person, and storing said ideas;

(b) storing the PSPI in said device;

(c) displaying the statements one after another in a random sequence on the display means;

(d) entering the truth value (true/false) directly after the display of the corresponding statement by pushing one or more buttons of the entering means;

(e) comparing the entered truth value with a counterpart stored in the device;

(f) counting the number of correct entries made, after the comparison of all entered truth values; and (g) deciding whether the authentication is positive, depending on the counted number of correct entries made.

3. An authentication method according to claim 1, wherein the PSPI consist of a plurality of associated pairs of the type Ax-Bx-Cx, and comprising one or more of the following steps:

(a) the associated pairs of elements Ax are assembled in one group and matched A with x in a certain sequence; the associated pairs of elements Bx are assembled in another group and are consecutively associated to the associated pairs of elements Ax by the person to be authenticated; the associated pairs of elements Cx are assembled in a third group and are consecutively associated to the associated pairs of elements Ax or Bx by the person to be authenticated;

(b) signs are attributed to the associated pairs of elements Ax, Bx, Cx, or to part of them; controllable authentication criteria are formed from the matching scheme of the associated pairs of elements Ax, Bx, Cx, or from the scheme of the attributed signs;

(c) the associated pairs of elements Ax, Bx and Cx are words or text;

(d) the associated pairs of elements Ax, Bx and Cx are proper names, properties, or numbers;

(e) the associations are pairwise associations of the type Ax-Bx, the associated pairs of elements Ax being registered along one axis of a two-dimensional matrix, and the associated pairs of elements Bx being registered in a random manner along the other axis of the matrix; the points of intersection of straight lines drawn parallel to the axes through registration marks corresponding to the associated pairs of elements Ax, Bx defining a two-dimensional pattern; numbers, or actuators which generate a physical effect when the person to be authenticated connects corresponding elements Ax-Bx of both axes, being attributed to the points of intersection of the straight lines;

(f) the associations are multiple associations of the type Ax, Bx and Cx, the texts of the same category A, B and C and the signs attributed to them being arranged one beneath the other in juxtaposed columns of a matrix, such that the elements Ax, Bx and Cx which are correlated one with another are distributed in a random manner in different matrix columns; the scheme for matching the texts being as follows: start with an element A1 of the first column, then go to element B1 of the second column which is correlated with element A1, then go to element C1 of the third column which is correlated with element B1, and so on; then go to element A2 of the first column which is placed in the same row of the matrix as the element of the last column which has been matched-up then go to element B2 which is correlated with element A2; the matching process being terminated when the last element of the last column has been matched-up;

(g) alphanumeric parts of secret codes and supplementary letters or numbers, or integer numbers, or prime numbers, or series of numbers are utilized as attributed signs;

(h) attributed signs which are arranged in different columns or patterns, are correlated to certain time periods or to certain authentication processes;

(i) the attributed signs are stored in an authentication device, the signs becoming available only after a successful authentication;

(j) the associations are multiple associations of the type Ax, Bx and Cx, authentication criteria being constructed by the following operations:

(1) numbers attributed to the associated elements (called "basic" numbers) are brought into a characteristic geometrical pattern according to the matching scheme of the associated elements, or they are transformed into characteristic result numbers by calculation, each result number being a function of all or a part of the basic numbers and of their arrangement, or of the sequence in which the basic numbers are introduced into the calculation; and (2) every two, three or more basic numbers which follow each other in the matching scheme, are multiplied with each other, the calculated products are raised to a power, and the numbers thus produced are added to a total result number having a large number of digits;

(k) the texts, basis numbers, the result number and possible parameters of the calculation process are stored in a unique identity card which is readable by an authentication device, or are stored in a portable miniaturised authentication device;

(l) the result number is used as the unique number of the identity card;

(m) the authentication device is equipped with a display, which exhibits the matrix built up from the texts after introducing the identity card into the device or after putting the device into operation, the owner of the card matching the texts by means of the displayed matrix, and a program installed in the authentication device automatically calculating the result number from the basic numbers;

(n) the basic numbers, the result number and other relevant data are automatically entered into an intermediary mechanical, electronic or magnetic short-term data carrier, from which they can be evaluated for renewed authentication by a remotely located reading device within a determined time interval, these data being cancelled after the reading process or after the time interval has passed; and (o) one of the basic numbers is modified after each authentication process, a new result number being calculated on that basis; the original result number and unmodified basic number, as well as the modified basic number and the new result number being transmitted to a remote authentication means, having access to a data processing device; the latter containing in electronic form and protected against unauthorised retrieval the matched chain of basic numbers together with the original result number and the calculation algorithm for each participant in the authentication system; after entering the original result number, the original and the modified basic number into the data processing device, the corresponding original basic number of the chain stored in the device is changed and a new result number is calculated and sent to a display, or is automatically compared with the transmitted new result number.

4. An authentication method according to claim 1, comprising one or more of the following:

(a) identity cards which contain a plurality of associated surnames and first names, basic numbers which are attributed to them, and the result number calculated from these basic numbers;

(b) a fixed data processing device which contains supplementary PSPI or biometrical data concerning the persons participating in the authentication system;

(c) an authentication device with screen or touch-screen which displays after introduction of an identity card all or part of the first names and consecutively one surname at a time or simultaneously several or all surnames, and which in addition displays the main parts of the supplementary PSPI which are transmitted from the fixed data processing device, and other information;

(d) means of interaction, such as a keyboard or a touch-screen pen for matching the displayed surnames with first names and for verifying or complementing the displayed PSPI main parts;

(e) hardware and software for implementing the authentication functions, such as displaying the surnames, first names, PSPI main parts and other data on the screen, matching surnames with first names, processing numbers, verification of statements, comparison of data with stored counterparts, release of a result signal;

(f) an authentication device with touch-screen, comprising one or more of the following steps:

(1) the person to be authenticated touches the correlated first name after the display of each surname;

(2) touching a wrong first name is undone by touching an undo-field;

(3) each successive surname is displayed after touching a first name; and (4) after matching all surnames and first names, the authentication device calculates a result number from the corresponding chain of basic numbers, and signals successful authentication, if the calculated result number coincides with the result number stored in the identity card.

5. An authentication method according to claim 1, wherein an original result number, and a new result number calculated from a modified set of basic numbers, are calculated and wholly or partially transmitted for comparison with corresponding result numbers produced in a data processing device.

6. An authentication method according to claim 1, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more basic numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authentication; and (8) locking of the following processes after invalid, unsuccessful or inadmissible attempts at authentication: actuation of the authentication device, display of words, display of numbers and letters, and change of the basic numbers attributed to the buttons or fields.

7. An authentication method according to claim 1, comprising one or more of the following:

(a) a subsequent PSPI element is only emitted after processing of the preceding PSPI has been completed;

(b) an actuator is activated automatically or by an externally applied signal, after successful authentication;

(c) renewed authentication processes are initiated automatically or by external action on the authentication device on the basis of other PSPI, after certain intervals; and (d) stored PSPI are partially or wholly replaceable or reproducible, subject to security measures.

8. An authentication method according to claim 1, wherein all the essential device components are assembled in a single miniaturized unit like an electronic key, the casing of which comprises:

(a) a display for displaying the PSPI elements, (b) a button for calling-up, verifying or falsifying, and cancelling text on the display, and (c) a docking area for the transmission of a signal from the unit for a period of time after a successful authentication.

9. An authentication method according to claim 1, wherein, for the purposes of authentication by a telecommunication link, the display and device for entering PSPI complements 1 is situated at a site S1 of a person P1, and is connected via a telecommunication link with the display and device for entering PSPI complements 2 of a person P2 at a site S2, the person P2 entering the identify card of person P1 and for inverse authentication, the person P1 entering the identity card of person P2.

10. An authentication method according to claim 1, comprising one or more of the following:

(a) the PSPI of a plurality of persons are entered and stored in a central data bank, from where they are transmitted without their PSPI complements, for authentication and on demand of the person to be authenticated or during certain time periods, to a decentralised control and one or more remotely operated stations, each equipped with a display and entering means for the PSPI complements; and (b) additional PSPI are available on individual identity cards in addition to the PSPI stored in the central data bank, authentication being implemented at the decentralised stations on the basis of both stores of PSPI.

11. An authentication method according to claim 3, comprising one or more of the following:

(a) identity cards which contain a plurality of associated surnames and first names, basic numbers which are attributed to them, and the result number calculated from these basic numbers;

(b) a fixed data processing device which contains supplementary PSPI or biometrical data concerning the persons participating in the authentication system;

(c) an authentication device with screen or touch-screen which displays after introduction of an identity card all or part of the first names and consecutively one surname at a time or simultaneously several or all surnames, and which in addition displays the main parts of the supplementary PSPI which are transmitted from the fixed data processing device, and other information;

(d) means of interaction, such as a keyboard or a touch-screen pen for matching the displayed surnames with first names and for verifying or complementing the displayed PSPI main parts;

(e) hardware and software for implementing the authentication functions, such as displaying the surnames, first names, PSPI main parts and other data on the screen, matching surnames with first names, processing numbers, verification of statements, comparison of data with stored counterparts, release of a result signal;

(f) an authentication device with touch-screen, wherein:

(1) the person to be authenticated touches the correlated first name after the display of each surname;

(2) touching a wrong first name is undone by touching an undo-field;

(3) each successive surname is displayed after touching a first name; and (4) after matching all surnames and first names, the authentication device calculates a result number from the corresponding chain of basic numbers, and signals successful authentication, if the calculated result number coincides with the result number stored in the identity card.

12. An authentication method according to claim 3, wherein an original result number, and a new result number calculated from a modified set of basic numbers, are calculated and wholly or partially transmitted for comparison with corresponding result numbers produced in a data processing device.

13. An authentication method according to claim 4, wherein an original result number, and a new result number calculated from a modified set of basic numbers, are calculated and wholly or partially transmitted for comparison with corresponding result numbers produced in a data processing device.

14. An authentication method according to claim 11, wherein an original result number, and a new result number calculated from a modified set of basic numbers, are calculated and wholly or partially transmitted for comparison with corresponding result numbers produced in a data processing device.

15. An authentication method according to claim 3, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more basic numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authentication; and (8) locking of the following processes after invalid, unsuccessful or inadmissible attempts at authentication: actuation of the authentication device, display of words, display of numbers and letters, and change of the basic numbers attributed to the buttons or fields.

16. An authentication method according to claim 4, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more basic numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authentication; and (8) locking of the following processes after invalid, unsuccessful or inadmissible attempts at authentication: actuation of the authentication device, display of words, display of numbers and letters, and change of the basic numbers attributed to the buttons or fields.

17. An authentication method according to claim 11, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more basic numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authentication; and (8) locking of the following processes after invalid, unsuccessful or inadmissible attempts at authentication: actuation of the authentication device, display of words, display of numbers and letters, and change of the basic numbers attributed to the buttons or fields.

18. An authentication method according to claim 5, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more basic numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authentication; and (8) locking of the following processes after invalid, unsuccessful or inadmissible attempts at authentication: actuation of the authentication device, display of words, display of numbers and letters, and change of the basic numbers attributed to the buttons or fields.

19. An authentication method according to claim 12, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more basic numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authenication; and (8) locking of the following processes after invalid, unsuccessful or inadmissible attempts at authentication: actuation of the authentication device, display of words, display of numbers and letters, and change of the basic numbers attributed to the buttons or fields.

20. An authentication method according to claim 13, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more basic numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authentication; and (8) locking of the following processes after invalid, unsuccessful or inadmissible attempts at authentication: actuation of the authentication device, display of words, display of numbers and letters, and change of the basic numbers attributed to the buttons or fields.

21. An authentication method according to claim 14, comprising one or more of the following:

(a) a casing like that of a small, flat electronic pocket calculator;

(b) an electronically active identity card having the format of a credit card;

(c) a display for displaying numbers and letters;

(d) a photovoltaic or galvanic energy supply;

(e) one or more buttons for switching on the authentication device and initiating additional functions;

(f) a display area for words which are arranged in two columns and which are generated by writing, optically or electronically;

(g) a transparent cover for the display area under which cover a two-column board for displaying words is located permanently or interchangeably;

(h) push-buttons or touch-screen fields which are located in a column corresponding to the word columns, being consecutively actuated by the person to be authenticated according to the matching scheme of the words, such that each actuation releases a predetermined basic number for the calculations in the authentication device;

(i) inscription of any combination of the numbers 0 to 9 and letters on the buttons or fields;

(j) electronic functions implementing all or part of the following processes:

(1) attribution of one or more button numbers to each button or field, subsequent basic numbers only being activated after the initially attributed basic numbers of all buttons or fields have been changed;

(2) display of the last calculated result number;

(3) calculation and display of a new result number based on the released basic numbers;

(4) generation of numbers by processes such as: actuating buttons or fields inscribed with numbers; by scrolling through a series of numbers in the display and stopping the scroll process when the desired number appears; and random number generation;

(5) attribution of numbers to the buttons or fields to serve as basic numbers, or to be stored as a secret code (PIN);

(6) generation of letters by actuating buttons or fields inscribed with letters;

(7) display of stored information after successful authentication; and (8) locking of the following processes after invalid, unsuccessful or inadmissible attempts at authentication: actuation of the authentication device, display of words, display of numbers and letters, and change of the basic numbers attributed to the buttons or fields.

22. An authentication method according to claim 2, comprising one or more of the following:

(a) a subsequent PSPI element is only emitted after processing of the preceding PSPI has been completed;

(b) an actuator is activated automatically or by an externally applied signal, after successful authentication;

(c) renewed authentication processes are initiated automatically or by external action on the authentication device on the basis of other PSPI, after certain intervals; and (d) stored PSPI are partially or wholly replaceable or reproducible, subject to security measures.

23. An authentication method according to claim 2 wherein all the essential device components are assembled in a single miniaturized unit like an electronic key, the casing of which comprises:

(a) a display for displaying the PSPI elements, (b) a button for calling-up, verifying or falsifying, and cancelling text on the display, and (c) a docking area for the transmission of a signal from the unit for a period of time after a successful authentication.

24. An authentication method according to claim 2 wherein, for the purposes of authentication by a telecommunication link the display and device for entering PSPI complements 1 is situated at a site S1 of a person P1, and is connected via a telecommunication link with the display and device for entering PSPI complements 2 of a person P2 at a site S2, the person P2 entering the identify card of person P1 and for inverse authentication, the person P1 entering the identity card of person P2.

25. An authentication method according to claim 2, comprising one or more of the following:

(a) the PSPI of a plurality of persons are entered and stored in a central data bank, from where they are transmitted without their PSPI complements, for authentication and on demand of the person to be authenticated or during certain time periods, to a decentralised control and one or more remotely operated stations, each equipped with a display and entering means for the PSPI complements; and (b) additional PSPI are available on individual identity cards in addition to the PSPI stored in the central data bank, authentication being implemented at the decentralised stations on the basis of both stores of PSPI.

* * * * *